US008884602B2

(12) United States Patent
Utsunomiya

(10) Patent No.: US 8,884,602 B2
(45) Date of Patent: Nov. 11, 2014

(54) REFERENCE VOLTAGE CIRCUIT

(71) Applicant: Seiko Instruments Inc., Chiba (JP)

(72) Inventor: Fumiyasu Utsunomiya, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 13/780,745

(22) Filed: Feb. 28, 2013

(65) Prior Publication Data

US 2013/0241525 A1 Sep. 19, 2013

(30) Foreign Application Priority Data

Mar. 13, 2012 (JP) ..... 2012-055922

(51) Int. Cl.

| | |
|---|---|
| ***G05F 3/16*** | (2006.01) |
| ***G05F 3/20*** | (2006.01) |
| ***G05F 1/10*** | (2006.01) |
| ***G05F 3/02*** | (2006.01) |

(52) U.S. Cl.

CPC ..... *G05F 3/02* (2013.01)
USPC ..... 323/313; 323/314; 323/315; 327/539

(58) Field of Classification Search

CPC ..... G05F 3/02; G05F 3/16; G05F 3/22; G05F 3/222; G05F 3/225; G05F 3/227; G05F 3/24; G05F 3/242; G05F 3/245; G05F 3/247; G05F 3/26; G05F 3/262; G05F 3/265; G05F 3/267; G05F 3/30; G05F 1/567
USPC ..... 323/274, 281, 312–318, 907; 327/512, 327/513, 538–543, 530; 331/176
See application file for complete search history.

(56) References Cited

U.S. PATENT DOCUMENTS

| | | | | |
|---|---|---|---|---|
| 6,133,718 | A * | 10/2000 | Calafato et al. | 323/312 |
| 6,798,278 | B2 * | 9/2004 | Ueda | 327/541 |
| 7,215,187 | B2 * | 5/2007 | Lam et al. | 327/543 |
| 7,474,145 | B2 * | 1/2009 | Negoro | 327/543 |
| 2007/0030049 | A1 | 2/2007 | Yoshikawa | |
| 2012/0242317 | A1 * | 9/2012 | Utsunomiya | 323/313 |

FOREIGN PATENT DOCUMENTS

JP 2007-024667 A 2/2007

* cited by examiner

*Primary Examiner* — Timothy J Dole
*Assistant Examiner* — Carlos Rivera-Perez
(74) *Attorney, Agent, or Firm* — Brinks Gilson & Lione

(57) ABSTRACT

A constant current flowing through a first depletion transistor whose gate and source are connected to each other is caused to flow through a second depletion transistor having the same threshold as the first depletion transistor, to thereby generate a first voltage between a gate and a source of the second depletion transistor. The constant current of the first depletion transistor and a constant current flowing through a third depletion transistor whose gate and source are connected to each other are caused to flow through a fourth depletion transistor. A threshold of the fourth depletion transistor is the same as that of the third depletion transistor but different from that of the first depletion transistor, and hence a second voltage is generated between a gate and a source of the fourth depletion transistor. A reference voltage is generated based on a voltage difference between the first and second voltages.

2 Claims, 3 Drawing Sheets

REFERENCE VOLTAGE CIRCUIT

RELATED APPLICATIONS

This application claims priority under 35 U.S.C. §119 to Japanese Patent Application No. 2012-055922 filed on Mar. 13, 2012, the entire content of which is hereby incorporated by reference.

BACKGROUND OF THE INVENTION

1. Field of the Invention

The present invention relates to a reference voltage circuit with improved temperature characteristics.

2. Description of the Related Art

As illustrated in FIG. 3, a conventional reference voltage circuit includes an N-channel depletion transistor 501 and an N-channel depletion transistor 502.

The operation is described. When a power supply voltage is sufficiently high, the N-channel depletion transistor 501 operates in the saturation region and the N-channel depletion transistor 502 operates in the triode region (variable resistance region). The aspect ratio of the N-channel depletion transistor 501 is represented by A1; the threshold thereof, Vtd; the aspect ratio of the N-channel depletion transistor 502, A2; and the threshold thereof, Vtd. A voltage V521 at an output terminal 521 is determined as follows.

$$V_{521} = \left(1 - \frac{\sqrt{A_{502}^2 + A_{501} \cdot A_{502}}}{A_{502}}\right) V_{td} \tag{1}$$

A temperature gradient of the voltage V521 is determined as follows.

$$\frac{dV_{521}}{dt} = \left(1 - \frac{\sqrt{A_{502}^2 + A_{501} \cdot A_{502}}}{A_{502}}\right) \frac{dV_{td}}{dt} \tag{2}$$

As is apparent from Expressions (1) and (2), the conditional expressions of the absolute value of the output voltage V521 and the temperature gradient are determined only by the thresholds and the channel aspect ratios of the depletion transistors and include no terms affected by the mobility.

In general, the temperature gradient of the mobility is nonlinear. The temperature gradient of the threshold, on the other hand, is known to be regarded as linear at about −1 to −2 mV/° C. If the ratio of the aspect ratios of the N-channel depletion transistor 501 and the N-channel depletion transistor 502 is adjusted to 1:8 as a realistic value, the value of the output voltage V521 is |2×Vtd|, and the temperature gradient is given as −2 times the temperature gradient of the same threshold.

As described above, the mobility is not involved in the elements that determine the output voltage and the output characteristics, and hence the output voltage and the output characteristics are determined only by the thresholds of depletion transistors and the ratio accuracy in layout. Further, there are a small number of elements that have manufacturing fluctuations, and hence a stable output can be obtained (see, for example, Japanese Patent Application Laid-open No. 2007-24667 (FIG. 1)).

In the conventional technology, however, a constant gradient is present with respect to temperature, and hence there is a problem in that it is not suitable for a reference voltage circuit which is required to have flat temperature characteristics.

SUMMARY OF THE INVENTION

The present invention has been made in view of the above-mentioned problem, and provides a reference voltage circuit capable of obtaining flat temperature characteristics with respect to a temperature change.

In order to solve the conventional problem, the reference voltage circuit according to the present invention has the following configuration.

The reference voltage circuit includes: a first depletion transistor including: a drain to which a voltage based on a voltage of a power supply terminal is input; and a gate and a source which are electrically connected to each other; a second depletion transistor including: a drain to which the voltage based on the voltage of the power supply terminal is input; a gate connected to a first terminal to which a predetermined voltage is input; and a source connected to a second terminal; a third depletion transistor including: a drain to which the voltage based on the voltage of the power supply terminal is input; and a gate and a source which are electrically connected to each other; and a fourth depletion transistor including: a drain to which the voltage based on the voltage of the power supply terminal is input; a gate connected to a third terminal to which a predetermined voltage is input; and a source connected to a fourth terminal, in which the first terminal and the third terminal are configured to input a desired voltage so that a current based on a current flowing through the first depletion transistor flows through the second depletion transistor, in which a total current of the current based on the current flowing through the first depletion transistor and a current based on a current flowing through the third depletion transistor flows through the fourth depletion transistor, in which the reference voltage circuit is configured to generate a reference voltage based on a voltage difference between a voltage generated between the first terminal and the second terminal and a voltage generated between the third terminal and the fourth terminal, in which the first depletion transistor and the second depletion transistor have the same threshold, and the third depletion transistor and the fourth depletion transistor have the same threshold, and in which the first depletion transistor and the third depletion transistor have different thresholds.

According to the reference voltage circuit of the present invention, the reference voltage is generated based on a threshold difference between the depletion transistors having different threshold voltages. Thus, the reference voltage circuit capable of obtaining flat temperature characteristics with respect to a temperature change can be provided.

DETAILED DESCRIPTION OF THE PREFERRED EMBODIMENTS

First Embodiment

Figure 1:
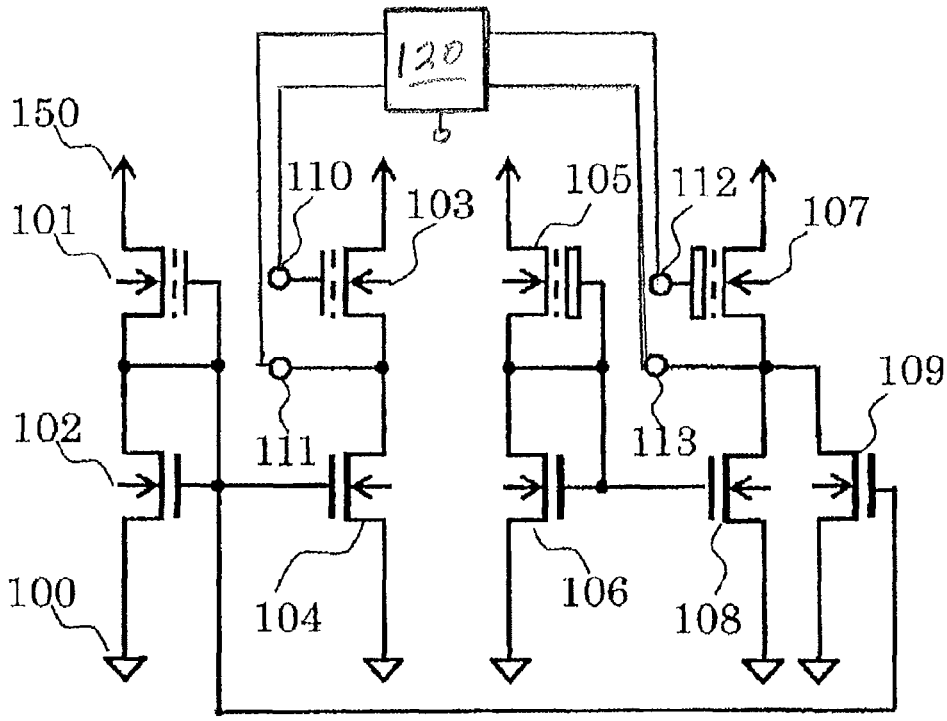
FIG. 1 is a circuit diagram illustrating a reference voltage circuit according to a first embodiment of the present invention.

FIG. 1 is a circuit diagram of a reference voltage circuit according to a first embodiment of the present invention.

The reference voltage circuit according to the first embodiment includes N-channel depletion transistors 101, 103, 105, and 107, N-channel transistors 102, 104, 106, 108, and 109, a power supply terminal 150, a ground terminal 100, a first terminal 110, a second terminal 111, a third terminal 112, and a fourth terminal 113.

Next, connections in the reference voltage circuit according to the first embodiment are described.

The N-channel depletion transistor 101 has a drain connected to the power supply terminal 150, and a gate and a source which are connected to a gate and a drain of the N-channel transistor 102, a gate of the N-channel transistor 104, and a gate of the N-channel transistor 109. The N-channel transistor 102 has a source connected to the ground terminal 100. The N-channel depletion transistor 103 has a drain connected to the power supply terminal 150, a gate connected to the first terminal 110, and a source connected to the second terminal 111. The N-channel transistor 104 has a drain connected to the second terminal 111 and a source connected to the ground terminal 100. The N-channel depletion transistor 105 has a drain connected to the power supply terminal 150, and a gate and a source which are connected to a gate and a drain of the N-channel transistor 106 and a gate of the N-channel transistor 108. The N-channel transistor 106 has a source connected to the ground terminal 100. The N-channel depletion transistor 107 has a drain connected to the power supply terminal 150, a gate connected to the third terminal 112, and a source connected to the fourth terminal 113. The N-channel transistor 108 has a drain connected to the fourth terminal 113 and a source connected to the ground terminal 100. The N-channel transistor 109 has a drain connected to the fourth terminal 113 and a source connected to the ground terminal 100. Then, a predetermined voltage is input to the first terminal 110 and the third terminal 112.

Next, the operation of the reference voltage circuit according to the first embodiment is described.

The N-channel depletion transistors 101 and 103 are set to have the same threshold Vtnd1. The N-channel depletion transistors 105 and 107 are set to have the same threshold Vtnd2. The thresholds Vtnd1 and Vtnd2 are set to be different from each other. When a sufficiently high voltage is applied to the power supply terminal 150, a constant current flows through the N-channel depletion transistors 101 and 105. The constant current flowing through the N-channel depletion transistor 101 then flows through the N-channel transistor 102, and is thereby copied to the N-channel transistor 104 at a predetermined ratio. The constant current copied at the predetermined ratio flows through the N-channel depletion transistor 103, and then a predetermined voltage is generated between the first terminal 110 which is the gate of the N-channel depletion transistor 103 and the second terminal 111 which is the source of the N-channel depletion transistor 103.

In addition, the constant current flowing through the N-channel depletion transistor 101 then flows through the N-channel transistor 102, and is thereby copied also to the N-channel transistor 109 at a predetermined ratio. Further, the constant current flowing through the N-channel depletion transistor 105 then flows through the N-channel transistor 106, and is thereby copied to the N-channel transistor 108 at a predetermined ratio. A current obtained by adding together this constant current copied at the predetermined ratio and the constant current flowing through the N-channel depletion transistor 101 copied to the N-channel transistor 109 at the predetermined ratio flows through the N-channel depletion transistor 107. Then, a predetermined voltage is generated between the third terminal 112 which is the gate of the N-channel depletion transistor 107 and the fourth terminal 113 which is the source of the N-channel depletion transistor 107.

Then, a multiplier unit 120 of the reference voltage circuit generates a reference voltage obtained by multiplying a voltage difference between the voltage generated between the first terminal 110 and the second terminal 111 and the voltage generated between the third terminal 112 and the fourth terminal 113 by a predetermined factor.

In this case, the voltage generated between the first terminal 110 and the second terminal 111 is a value obtained by multiplying the threshold Vtnd1 by a coefficient determined by a K value ratio of the N-channel depletion transistor 101 and the N-channel depletion transistor 103 and a K value ratio of the N-channel transistor 102 and the N-channel transistor 104. Further, the voltage generated between the third terminal 112 and the fourth terminal 113 is, when the current copied to the N-channel transistor 109 is a minute current, a value obtained by multiplying the threshold Vtnd2 by a coefficient determined by the threshold Vtnd2 of the N-channel depletion transistor 105 and the N-channel depletion transistor 107 and a K value ratio thereof and a K value ratio of the N-channel transistor 106 and the N-channel transistor 108. Therefore, when the current copied to the N-channel transistor 109 is a minute current and when the coefficients that multiply the thresholds Vtnd1 and Vtnd2 are the same value, the voltage difference between the voltage generated between the first terminal 110 and the second terminal 111 and the voltage generated between the third terminal 112 and the fourth terminal 113 is a value obtained by multiplying the voltage difference between the threshold Vtnd1 and the threshold Vtnd2 by the coefficient. Further, the voltage difference between the threshold Vtnd1 and the threshold Vtnd2 hardly changes depending on temperature.

Therefore, by generating a reference voltage obtained by multiplying the voltage difference between the voltage generated between the first terminal 110 and the second terminal 111 and the voltage generated between the third terminal 112 and the fourth terminal 113 by a predetermined factor, a reference voltage circuit capable of generating a reference voltage that changes little depending on temperature can be formed. However, the voltage difference between the threshold Vtnd1 and the threshold Vtnd2 slightly increases with an increase in temperature. Further, an increase amount of the voltage difference becomes smaller as the temperature becomes higher. In order to further reduce the change in voltage difference caused by a temperature change, in the reference voltage circuit according to the first embodiment, the coefficient that multiplies the threshold Vtnd1 and the coefficient that multiplies the threshold Vtnd2 are different from each other. In this way, the above-mentioned voltage difference is prevented from increasing with the increase in temperature. Further, the N-channel transistor 109 is provided, and a current obtained by multiplying the constant current of the N-channel depletion transistor 101 having the threshold Vtnd1 by the coefficient is copied to the N-channel transistor 109. In this way, the voltage generated between the gate and source of the N-channel depletion transistor 107 is adjusted to prevent the decrease in the increase amount of the above-mentioned voltage difference caused by the increase in temperature.

As described above, according to the reference voltage circuit of the first embodiment having the above-mentioned configuration, two N-channel depletion transistors having different thresholds are provided, and a reference voltage is generated with the use of the threshold difference between the two N-channel depletion transistors. Further, the configuration of correcting the temperature change in the threshold difference is added, and hence a reference voltage having a very small voltage change caused by the temperature change can be generated.

Second Embodiment

Figure 2:
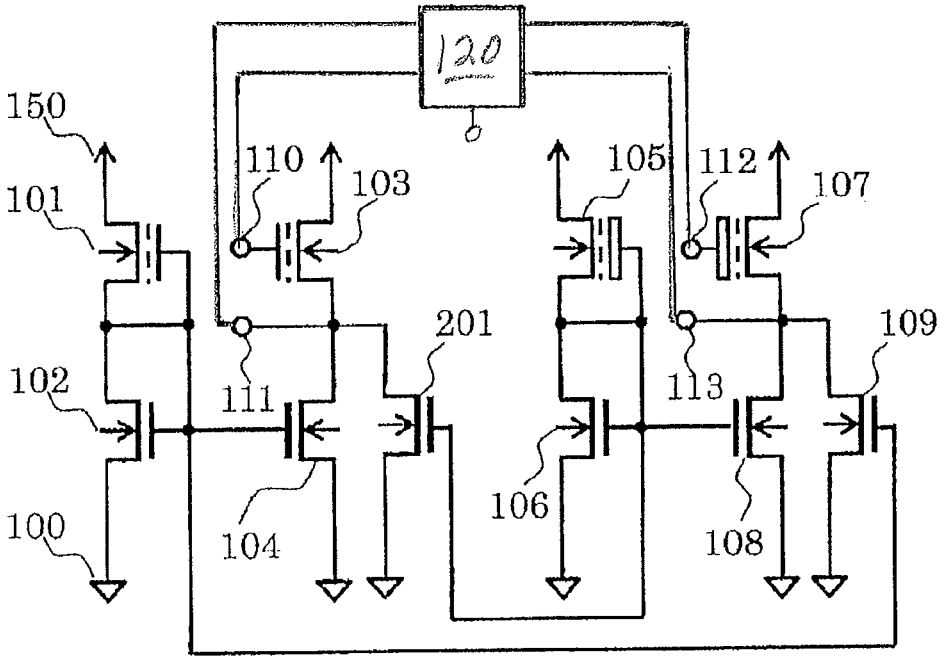
FIG. 2 is a circuit diagram illustrating a reference voltage circuit according to a second embodiment of the present invention.
Figure 3:
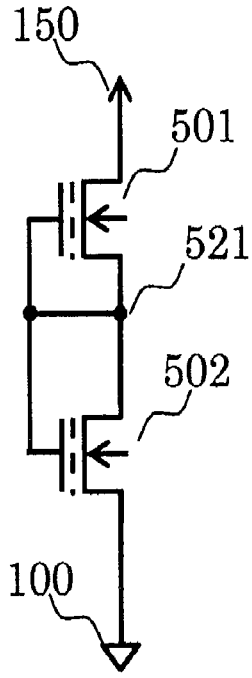
FIG. 3 PRIOR ART
FIG. 3 is a circuit diagram illustrating a conventional reference voltage circuit.

FIG. 2 is a circuit diagram of a reference voltage circuit according to a second embodiment of the present invention.

The second embodiment is different from the first embodiment of FIG. 1 in that an N-channel transistor 201 having a drain connected to the second terminal 111, a gate connected to the gate and drain of the N-channel transistor 106, and a source connected to the ground terminal 100 is added.

By adding the above-mentioned N-channel transistor 201, the constant current of the N-channel depletion transistor 105 flowing through the N-channel transistor 106 then flows through the added N-channel transistor 201 at a predetermined ratio, and hence the current flowing through the added N-channel transistor 201 can adjust the voltage generated between the gate and source of the N-channel depletion transistor 103.

Therefore, according to the reference voltage circuit of the second embodiment, in addition to the function of the reference voltage circuit of the first embodiment which adjusts the voltage generated between the gate and source of the N-channel depletion transistor 107 by the current obtained by multiplying the constant current of the N-channel depletion transistor 101 by a coefficient, the function of adjusting the voltage generated between the gate and source of the N-channel depletion transistor 103 by the current obtained by multiplying the constant current of the N-channel depletion transistor 105 by a coefficient can be added. Therefore, according to the reference voltage circuit of the second embodiment, the decrease in the increase amount of the above-mentioned voltage difference caused by the increase in temperature can be adjusted also by the voltage generated between the gate and source of the N-channel depletion transistor 103. Thus, as compared with the reference voltage circuit of the first embodiment, the decrease in the increase amount of the above-mentioned voltage difference caused by the increase in temperature can be corrected more accurately, and hence a reference voltage having a small voltage change caused by the temperature change can be generated.

Note that, the present invention has the feature of obtaining a reference voltage having a small voltage fluctuation caused by a temperature change in the following manner. A current flowing through a first depletion transistor having a low threshold whose gate and source are connected to each other, or a current generated based on this current is caused to flow through a second depletion transistor having the same threshold, to thereby generate a voltage between a gate and a source of the second depletion transistor. Then, a current flowing through a third depletion transistor having a high threshold whose gate and source are connected to each other, or a current generated based on this current is caused to flow through a fourth depletion transistor having the same threshold, to thereby generate a voltage between a gate and a source of the fourth depletion transistor. In addition, the current flowing through the first depletion transistor or the current generated based on this current is caused to flow through the fourth depletion transistor, and the current flowing through the third depletion transistor or the current generated based on this current is caused to flow through the second depletion transistor. Then, a reference voltage is generated based on a difference between the voltage generated between the gate and source of the second depletion transistor and the voltage generated between the gate and source of the fourth depletion transistor. Thus, it should be understood that any circuit configuration that can realize the above-mentioned configuration can be employed.

What is claimed is:

1. A reference voltage circuit, comprising:

a first depletion transistor including: a drain to which a voltage based on a voltage of a power supply terminal is input; and a gate and a source which are electrically connected to each other;

a second depletion transistor including: a drain to which the voltage based on the voltage of the power supply terminal is input; a gate connected to a first terminal to which a predetermined voltage is input; and a source connected to a second terminal;

a third depletion transistor including: a drain to which the voltage based on the voltage of the power supply terminal is input; and a gate and a source which are electrically connected to each other;

a fourth depletion transistor including: a drain to which the voltage based on the voltage of the power supply terminal is input; a gate connected to a third terminal to which a predetermined voltage is input; and a source connected to a fourth terminal, wherein the first terminal and the third terminal are configured to input a desired voltage so that a current based on a current flowing through the first depletion transistor flows through the second depletion transistor, wherein a total current of the current based on the current flowing through the first depletion transistor and a current based on a current flowing through the third depletion transistor flows through the fourth depletion transistor, wherein the first depletion transistor and the second depletion transistor have the same threshold, and the third depletion transistor and the fourth depletion transistor have the same threshold, and wherein the first depletion transistor and the third depletion transistor have different thresholds; and a multiplier unit that generates a reference voltage by multiplying a voltage difference between a voltage generated between the first terminal and the second terminal and a voltage generated between the third terminal and the fourth terminal by a predetermined factor.

2. The reference voltage circuit according to claim 1, wherein the current based on the current flowing through the third depletion transistor also flows through the second depletion transistor.

* * * * *